United States Patent [19]

Crystal et al.

[11] 4,088,073

[45] May 9, 1978

[54] PROCESS FOR PREPARING INK RELEASING STENCIL

[75] Inventors: Richard G. Crystal, Dallas, Tex.; Frank J. Walton, Los Altos, Calif.

[73] Assignee: Xerox Corporation, Stamford, Conn.

[21] Appl. No.: 428,962

[22] Filed: Dec. 27, 1973

[51] Int. Cl.[2] ..... B41C 1/14; B41N 1/24

[52] U.S. Cl. ..... 101/128.4; 101/401.1; 101/465; 427/256

[58] Field of Search ..... 101/128.2–128.4, 101/455, 463, 466, 467, 470, 471, 395, 401.1, 426; 156/4, 5; 117/6, 35.5, 38, 62.1, 161 Z, 161 A, 132 BS; 96/35, 36, 36.2–36.4

[56] References Cited

U.S. PATENT DOCUMENTS

| | | | |
|---|---|---|---|
| 2,949,848 | 8/1960 | Mott | 101/128.3 |
| 3,002,848 | 10/1961 | Clark | 117/161 ZA |
| 3,215,527 | 11/1965 | Johnson | 101/401.1 X |
| 3,243,410 | 3/1966 | McVannel | 117/161 ZA |
| 3,264,258 | 8/1966 | Ceyzeriat | 117/161 ZA |
| 3,538,847 | 11/1970 | Heilman | 96/36.4 |
| 3,619,157 | 11/1971 | Brinckman | 101/463 |
| 3,682,633 | 8/1972 | Curtin | 101/463 X |
| 3,833,401 | 9/1974 | Ingram | 117/38 |

FOREIGN PATENT DOCUMENTS

| | | | |
|---|---|---|---|
| 1,004,237 | 9/1965 | United Kingdom | 101/395 |

*Primary Examiner*—Clyde I. Coughenour
*Attorney, Agent, or Firm*—J. J. Ralabate; J. P. O'Sullivan; D. M. MacKay

[57] ABSTRACT

A novel method for preparing a stencil master, a novel stencil and a method for printing therefrom are provided. The method for preparing the stencil comprises coating a suitable screen with a curable silicone containing a curing catalyst, depositing a particulate image pattern on said coated screen with a material which selectively inactivates said curing catalyst below said image pattern, curing the resultant nonimaged silicone to an elastomeric ink releasable condition and removing the particles from said particulate image pattern and the uncured silicone below said pattern to provide perforations in imagewise configuration. The method for printing comprises the additional steps of contacting the resultant screen with an image receiving member and passing ink through said perforations to thereby form an inked image on said receiving member.

11 Claims, 4 Drawing Figures

PROCESS FOR PREPARING INK RELEASING STENCIL

BACKGROUND OF THE INVENTION

In stencil printing a filled porous sheet is opened up where it is desired to make an ink flow for imaging; no ink can pass through unopened, blocked areas. Stencil printing includes both screen process printing and mimeograph duplicating. Stencil screens can be made of photoresists. For example, gelatin can be coated on a screen, sensitized by dichromate solution, dried, exposed and washed out to give an imaged screen. Ink can pass through where light has not struck. In mimeograph duplicating, imaged stencils consist essentially of ink-impervious coatings cut to expose a permeable sheet that permits ink to pass through. The stencils are wrapped around a rotating drum of a duplicator. This drum is perforated to permit ink brushed through it to pass to the stencil to image paper fed against the stencil on the drum.

In general, the processes for producing stencils are costly and time consuming. In addition, with existing stencils, ink tends to spread laterally beyond the image perforations by capillary action after extended printing, so as to ink the non-imaged areas. It is to these problems that this invention is directed.

DESCRIPTION OF THE INVENTION

It has now been discovered that stencils can be prepared which are ink releasing so that little or no ink spreads from the imaged areas to the nonimaged areas and that these stencils can be prepared by an inexpensive, simple camera speed imaging process. More particularly, it has been found that when a printing screen is prepared by coating a suitable screen with a curable silicone containing a curing catalyst and a particulate image pattern deposited on said coated screen with a material which selectively inactivates said curing catalyst below said image pattern, the silicone can be cured to an elastomeric ink-releasable condition and the particulate image pattern removed as well as the uncured silicone below said pattern to provide a stencil screen which can print for extended periods without any significant spreading of ink to the non-imaged areas.

Thus, because the silicone renders the screen ink releasing there is little or no tendency for the ink to spread from the imaged areas such that prints of good contrast and sharpness are obtained. In addition, the image can be electrostatographically formed and developed by conventional means so as to obviate the requirement for photoresists, as was previously required. Accordingly the novel screens of the invention can be rapidly and inexpensively prepared. Additionally the particulate image pattern and uncured gum below said pattern can be removed by conventional solvents to reveal perforations in imagewise configuration and prints made from the resultant screen employing conventional inks and methods of printing. Other benefits will be apparent from the following detailed description.

DETAILED DESCRIPTION OF THE INVENTION

Figure 1:
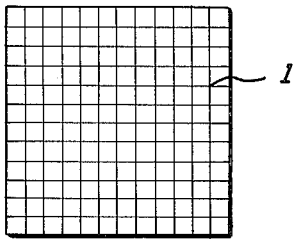
FIG. 1 is a top view of a stencil screen.
Figure 2:
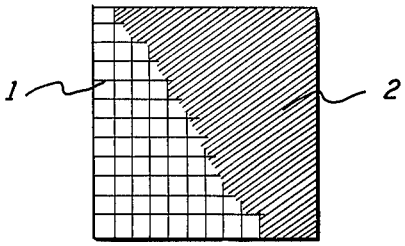
FIG. 2 depicts a stencil screen which is partially covered with a silicone which is curable to an elastomeric ink releasable condition.
Figure 3:
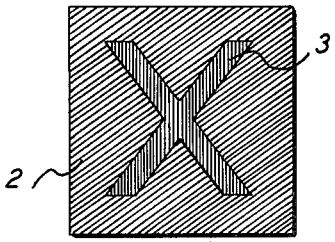
FIG. 3 depicts the completely coated stencil screen in which a particulate image pattern has been deposited.
Figure 4:
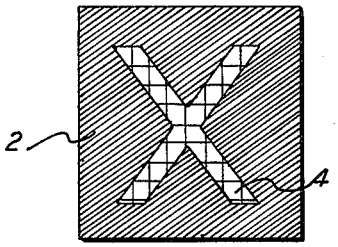
FIG. 4 depicts the screen in which the silicone has been cured in the non-imaged areas and the particulate image pattern and underlying uncured silicone below said pattern removed to reveal stencil pores through which ink can pass.

Referring now to the drawings, FIG. 1 is a stencil screen having a plurality of open pores 1. FIG. 2 depicts the stencil screen in which a portion of the screen 2 is coated with a curable silicone containing a curing catalyst. In FIG. 3, the coated screen is depicted with a particulate image pattern comprising a material which selectively inactivates the curing catalyst in the underlying silicone below said image pattern. In FIG. 4, the screen is shown in which the non-image areas 2 are cured to render the silicone ink releasable and the image areas 4 comprising the particulate image pattern and uncured silicone below said pattern are removed to reveal the stencil pores through which ink can be passed.

Screens which can be employed for the printing stencil include mesh, fabric or cloth formed of weavable non-woven and porous materials such as silk, nylon, Dacron, paper, polymeric foams and the like fibers as well as metal wires such, for example, brass and stainless steel. The screen will preferably have from 100 × 100 to 250 × 250 U.S. mesh, although larger and smaller screens can be employed.

Curable silicones which can be employed in the invention include silicone polymer gums and heterophase polymeric compositions having a silicone phase such as organopolysiloxane copolymers including block copolymers, graft and segmented copolymers, organopolysiloxane polymer blends, and copolymer stabilized polymer blends.

Ink releasable copolymers which can be employed comprise heterophase polymeric compositions consisting of an organopolysiloxane material and a nonsilicone polymeric material. Polymeric materials which can be employed as the non-silicone component of the heterophase polymeric composition include materials such as poly ($\alpha$- methylstyrene), polycarbonate, polysulfone, polystyrene, polyester, polyamide, acrylic polymers, polyurethane, and vinyl polymers. The present invention is not intended to be limited by the material for this nonsilicone phase.

While no limiting, preferred proportions for the heterophase polymeric composition comprise a ratio by weight of between about 95 to 50 parts organopolysiloxane to 5 to 50 parts of the nonsilicone polymeric phase. This ratio range of organopolysiloxane to nonsilicone polymer, provides suitable ink release materials for the ink release layer of the instant printing screen. Copolymers of the above type, could be typically prepared in a manner as is illustrated by the procedure for preparation of an organopolysiloxane/polystyrene block-copolymer as described in *Macromolecules,* Volume 3, January–February 1970, pages 1–4.

The silicones are applied to the screen by solvent casting techniques including dip coating or draw bar coating, etc. after dissolution in organic solvents which typically may be solvents such as benzene, hexane, heptane, tetrahydrofuran, toluene xylene, as well as other common aliphatic and aromatic solvents.

The thickness of the coating will depend on the type of silicone and catalyst employed. Generally, the silicone coating should be between 1 and 15 microns thick. A preferred range is between 2 and 8 microns. With the preferred peroxide catalysts, such as 2,4-dichlorobenzoyl peroxide, best results are obtained at a catalyst concentration of between 3 and 5 percent by weight of solids in the gum or polymer.

Other conventional peroxide silicone catalysts which can be employed include the diacyl peroxides and peroxy esters. Suitable diacyl peroxides include phthaloyl peroxide, phthalic acid peroxide, acetyl peroxide, decanoyl peroxide, lauroyl peroxide, and benzoyl peroxide. Suitable peroxy esters include t-butylperoxyacetate, di-t-butyldiperoxy succinate, di-t-butyldiperoxy carbonate, t-butylbenzene peroxylsulfonate, and t-butylperoxy carbonate. Other catalysts which can be employed include the azo compounds such as azo-bis-isobutyronitrile. Any catalyst can be employed which will catalyze the silicone and be inactivated by the toner image.

The particulate image pattern can be deposited by conventional techniques such as electrophotography, electrostatic printing, photoelectrophoresis and electrographic imaging. The particulate image is preferably developed on a separate photoconductive surface and electrostatically transferred to an intermediate member before transfer to the silicone gum. The means of development of the image will be dictated by the particular imaging technique, but insofar as conventional xerography is employed the image can be developed by cascade, magnetic brush and powder cloud development methods.

The particulate material or toner used to form the image should be one which will inactivate or poison the catalyst contained in the gum. Conventional toners which will inactivate the peroxide catalysts include thermoplastic polymers such as polymers of styrene. Typical styrene polymers include polystyrene, styrene-n-butyl-methacrylate copolymer and styrene-butadiene copolymer. Other materials which can be employed include: polyethylene, polypropylene, ethylene-vinyl acetate copolymers, propylene-modified polyethylene, acetals, acrylics, acrylonitrile-butadiene-styrene (ABS), polystyrene, cellulosics, chlorinated polyether, fluorochemicals, polyamides (nylons), polyimides, phenoxies and vinyls. It is only necessary that the toner make intimate contact with the silicone gum and inactivate the curing catalyst and thus a number of materials can be employed.

The silicones can be cured by heating for a brief period at elevated temperature. The time and temperature required for cure will depend upon the type employed, but generally a temperature between about 50° and 300° C and a time between about 20 seconds and about 2 minutes will be sufficient to cure and render the background areas non-adhesive but not cure the silicone under the particulate image. The cure conditions should be selected such that the silicone in the image areas does not become cured despite the inactivation of the silicone catalyst.

After the polymer is cured to an elastomeric ink releasable condition, the particles from the particulate image pattern, and the uncured silicone gum below can be removed by treating the screen with a solvent such as benzene or toluene or other hydrocarbon in which the uncured silicone gum and toner are soluble to reveal perforations in imagewise configuration.

The "imaged" stencil can then be affixed to a conventional frame such as wood or steel, the screen placed against a receiver member and ink pushed through the image perforations and onto the receiver member by conventional means such as a doctor blade. Alternatively, the stencil can be mounted on a mimeograph machine.

Typical inks can be employed in the printing method of the invention to include inks of the oleophilic type having the vehicle component for the ink pigments derived from various oleophilic materials such as aromatic and aliphatic hydrocarbons drying oil varnishes, lacquers, and solvent-type resins. Other suitable inks include the glycol and rubber based inks.

As an alternative embodiment, the screen can be coated with a photoconductive polymer and the silicone deposited thereon, or a photoconductive material incorporated into the silicone so as to permit the formation of an electrostatographic latent image directly on the screen.

"Photoconductive" as used herein means electrically photosensitive and conductive in response to activating electromagnetic radiation.

Typical photoconductive organic materials include substituted and unsubstituted organic pigments such as phthalocyanines, for example, copper phthalocyanine, beta form of metal-free phthalocyanine; tetrachlorophthalocyanine; and *x*-form of metal-free phthalocyanine; quinacridones, as, for example, 2,9-dimethylquinacridone; 4,11-dimethylquinacridone; 3,10-dichloro-6–13-dihydroquinacridone; 2,9-dimethoxy-6,13-dihydroquinacridone and 2,4,9,11-tetrachloroquinacridone; anthraquinones such as 1,5-bis-(beta-phenylethylamino)anthraquinone; 1,5-bis-(3′-methoxypropylamino)anthraquinone; 1,2,5,6-di-(C,C′-diphenyl)-thiazoleanthraquinone; 4-(2′-hydroxyphenyl-methoxyamino)anthraquinone; triazines such as 2,4-diaminotriazine; 2,4-di-(1′-anthraquinonylamino-6-(1″-pyrenyl)-triazine; 2,4,6 tri-(1′-1″,1‴-pyrenyl)triazine; azo compounds such as 2,4,6-tris (N-ethyl-p-aminophenylazo)phloroglucinol; 1,3,5,7-tetrahydroxy-2,4,6,8-tetra(N-methyl-N-hydroxylethyl-p-aminophenylazo) naphthalene; 1,3,5-trihydroxy-2,4,6-tri-(3′-nitro-N-methyl-N-hydroxymethyl-4′-aminophenylazo)benzene; metal salts and lakes of azo dyes such as calcium lake of 6-bromo-1-(1′-sulfo-2-naphthylazo)-2-naphthol; barium salt of 6-cyano-1-(1′-sulfo-2-naphthylazo)-2-naphthol; calcium lake of 1-(2′-azonaphthalene-1′-sufonic acid)-2-naphthol; calcium lake of 1-(4′-ethyl-5′-chloroazobenzene-2′-sulfonic acid)-2-hydroxy-3-naphthoic acid; and mixtures thereof.

Typical inorganic photoconductive compositions include cadmium sulfide, cadmium selenide, cadmium sulfo-selenide, zinc oxide, zinc sulfide, sulfur, selenium, antimony sulfide, lead oxide, lead sulfide, arsenic sulfide, arsenic-selenium, and mixtures thereof.

The photoconductive materials can be admixed with solid or liquid carriers and coated on the screen by the conventional methods as is well known to those skilled in the art. Typical solid carriers include sodium chloride, ammonium chloride, granular silicon, glass, silicon dioxide, steel and nickel. Typical liquid carriers include mineral oil, oleic acid, peanut oil, kerosene, and trichloroethylene.

In addition the screen can be coated with a photoconductive polymer. Typical polymers include poly-N-vinylcarbazole (PVK), poly-1-vinylpyrene (PVP), poly-9-vinylanthracene, polyacenaphthalene, poly-9-(4-pentenyl)carbazole, poly-9-(5-hexyl)-carbazole, polymethylenepyrene, poly-1-(pyrenyl)-butadiene and N-substituted polymeric acrylic acid amides of pyrene. Also included are derivatives of such polymers including alkyl, nitro, amino, halogen, and hydroxy substituted polymers. Typical examples are poly-3-aminocarbazole, 1,3-dibromo-poly-N-vinylcarbazole and 3,6-dibromo-poly-N-vinylcarbazole in particular derivatives of the formula:

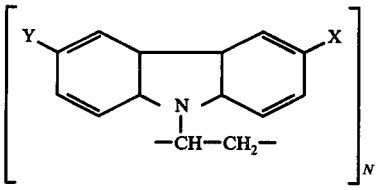

where X and Y are substituents and N is an integer. Also included are structural isomers of these polymers, typical examples include poly-N-vinylcarbazole, poly-2-vinylcarbazole, and poly-3-vinylcarbazole. Also included are co-polymers; typical examples are N-vinyl carbazole/methyl acrylate co-polymer and 1-vinyl pyrene/butadiene ABA, and AB block polymers. Typical nonpolymeric materials include carbazole, N-ethylcarbazole, N-phenylcarbazole, pyrene, tetraphene, 1-acetylpyrene, 2,3-benzochrysene, 6,7-benzopyrene, 1-bromopyrene, 1-ethylpyrene, 1-methylpyrene, perylene, 2-phenylindole, tetracene, picene, 1,3,6,8-tetraphenylpyrene chrysene, fluorene, fluroenone, phenanthrene, triphenylene, 1,2,5,6-dibenzanthracene, 1,2,3,4-dibenzanthracene, 2,3-benzopyrene, anthraquinone, dibenzothiophene, and naphthalene.

The following examples will serve to illustrate the invention and embodiments thereof. All parts and percentages in said examples and elsewhere in the specification and claims are by weight unless otherwise specified.

EXAMPLE I

A stencil master is prepared as follows. A stainless steel screen (325 × 325 U.S. mesh) is coated with a 10 micron thick layer of uncured polydimethylsiloxane gum manufactured by Dow Corning Corporation and sold under the designation 410, to which siloxane had been added 4 percent by weight 2,4-dichlorobenzoyl peroxide catalyst (Dow Corning TS-50). The gum and catalyst are dissolved in a 5 percent by weight solution of hexane and applied to the screen with a draw bar. The screen is allowed to dry at room temperature and evaporate the solvent and an electrostatic latent test image is deposited and cascade developed on a paper using the Xerox Model D processor. The particulate image pattern is then electrostatically transferred to the uncured silicone gum. The toner employed was Xerox 364 toner containing styrene/butyl-methacrylate copolymer. The resultant imaged silicone gum is then cured to an elastomeric ink releasable condition by heating the coated screen at a temperature of 150° C in an air oven of approximately 2 minutes. It was noted that only the nontoned areas were cured. The particles from said particulate image pattern and the uncured silicone gum below said pattern were removed by wiping first with acetone and then hexane. The resultant screen was then mounted on a frame, a paper sheet placed under the screen and an ink doctored through the screen. Several additional prints were made and it was found that the prints had high image density. In addition there was little lateral ink spreading normally found with screen printing.

EXAMPLE II

The procedure of Example I was repeated but for the exception that a nylon cloth (60 × 60 U.S. mesh) was employed as the screen. Good prints were obtained but the resolution was not as good as with the stainless steen screen.

EXAMPLE III

The procedure of Example I is repeated but for the exception that polystyrene is employed as the toner. Copies of good contrast are obtained.

EXAMPLE IV

The procedure of Example I is repeated but for the exception that polyethylene is employed as the toner. Copies of good image contrast are obtained.

EXAMPLE V

The procedure of Example I is repeated but for the exception that a styrene-butadiene block copolymer is employed as the toner. Copies of good image contrast are obtained.

Having described the present invention with reference to these specific embodiments, it is to be understood that numerous variations may be made without departing from the spirit of the present invention and it is intended to encompass such reasonable variations or equivalents within its scope.

What is claimed is:

1. A method for preparing a stencil comprising:

(a) providing a suitable screen, (b) coating said screen with a curable silicone containing a curing catalyst, (c) depositing a particulate image pattern on the coated screen, said pattern comprising a material which selectively inactivates said curing catalyst below said image pattern, (d) curing the silicone in the nonimage areas to an elastomeric ink releasable condition, and (e) removing the particles and the uncured silicone below said pattern.

2. The method of claim 1 wherein the silicone is a gum containing a peroxide catalyst.

3. The method of claim 2 wherein the catalyst concentration constitutes between 3 and 5 percent by weight of solids in the gum.

4. The method of claim 1 wherein the particulate image pattern is formed with a styrene polymer.

5. The method of claim 2 wherein the silicone gum contains a peroxide catalyst and the particulate image pattern is formed with a styrene polymer.

6. The method of claim 2 wherein the particles from said particulate image pattern and the uncured silicone gum below said pattern are removed with a solvent.

7. The method of claim 1 wherein the silicone is coated on the substrate to between 1 and 15 microns thick.

8. The method of claim 1 wherein the silicone is coated on the substrate to a thickness of between 2 and 8 microns.

9. The method of claim 2 wherein the peroxide catalyst is 2,4-dichlorobenzoyl peroxide.

10. The method of claim 1 wherein the screen is stainless steel.

11. A method of printing comprising:

(a) providing a suitable screen, (b) coating said screen with a curable silicone containing a curing catalyst, (c) depositing a particulate image pattern on said coated screen with a material which selectively inactivates said curing catalyst below said image pattern, (d) curing the resultant silicone in the nonimage areas to an elastomeric ink releasable condition, (e) removing the particles from said particulate image pattern and the uncured silicone below said pattern to provide perforations in imagewise configuration, and (f) contacting the resultant screen with an image receiving member and passing ink through said perforations to thereby form an inked image on said receiving member.

* * * * *